US005467994A

United States Patent [19]

Moriyama et al.

[11] Patent Number: 5,467,994

[45] Date of Patent: Nov. 21, 1995

[54] GOLF BALL

[75] Inventors: Keiji Moriyama, Akashi; Tadahiro Ebisuno, Nishinomiya; Kazushige Sugimoto, Akashi, all of Japan

[73] Assignee: Sumitomo Rubber Industries, Ltd., Hyogo, Japan

[21] Appl. No.: 331,819

[22] Filed: Oct. 31, 1994

[30] Foreign Application Priority Data

Nov. 2, 1993 [JP] Japan ..... 5-274690

[51] Int. Cl.[6] ..... A63B 37/08; A63B 37/14

[52] U.S. Cl. ..... 273/222; 273/231; 273/232

[58] Field of Search ..... 273/222, 223, 273/224, 225, 226, 227, 228, 229, 231, 232

[56] References Cited

U.S. PATENT DOCUMENTS 4,804,189 2/1989 Gobush ..... 273/232

5,033,749 7/1991 Kakiuchi et al. ..... 273/231 X 5,090,705 2/1992 Oka et al. ..... 273/232

5,192,079 3/1993 Sun et al. ..... 273/232

5,338,038 8/1994 Caforniga ..... 273/231 X

*Primary Examiner*—George J. Marlo

*Attorney, Agent, or Firm*—Birch, Stewart, Kolasch & Birch

[57] ABSTRACT

A golf ball (G) comprises a liquid center (1), a rubber thread layer (2) formed around the liquid center (1) and a cover (3) covering the rubber thread layer (2), wherein said liquid center (1) has a diameter (L1) of 29.5 to 32.0 mm and the ratio, Y, of the sum total of the flat surface area (5S) of dimples (5) to the surface area (G-1) of the same sphere having no dimples formed thereon is within the range of 0.80 to 0.84. The total volumes of dimples (5) are in the range of 290 to 340 $mm^3$. The dimples (5) include a plurality of kinds of dimples having different diameters.

4 Claims, 4 Drawing Sheets

GOLF BALL

BACKGROUND OF THE INVENTION

The present invention relates to a golf ball comprising a liquid center, a rubber thread layer formed around the liquid center and a cover covering the rubber thread layer and more particularly to a golf ball having a liquid center of a large diameter so as to increase flight distance, in which trajectory is optimized by improvement of the ratio of the total surface area of dimples to the total surface area of the golf ball.

Normally, 300 to 500 dimples in number are provided on the surface of a golf ball so as to improve aerodynamic characteristics of the golf ball through increase of the flight distance and optimization of the trajectory.

There are many dimple factors which affect the trajectory of the golf ball. One of the factors which has a large influence on the trajectory is the ratio of the total area of the dimples to the surface area of the golf ball, i.e. surface area occupying rate of the dimples.

Conventionally, in view of the surface area occupying rate of the dimples, there are proposals of the golf ball as listed below.

(1) In U.S. Pat. No. 4,804,189, the surface area occupying rate of the dimples is set to be more than 78% by a combination of two kinds of large and small dimples.

(2) In Japanese Patent Laid-Open Publication No. 3-80876 (U.S. Pat. No. 5,090,705), proposed by the present applicant, the dimples are formed so that a value Y of the surface area occupying rate of the dimples is within the range $$Y=0.046x^{1/2}-0.172$$

wherein X represents the total number of dimples.

As shown in FIG. 1, the golf ball G disclosed in the above references has a liquid center 1 and a rubber thread layer 2 formed around the liquid center 1 and a cover 3 covering the rubber thread layer 2, in which a diameter L1 of the liquid center 1 is about 28.3 mm, while an outer diameter L2 of the golf ball G is 42.75 mm.

Recently, in order to increase the flight distance of the golf ball of a liquid center type, a golf ball having a larger diameter owing to increase of the diameter of the liquid center 1 so as not only to decrease amount of spin at the initial stage of flying but also to increase an angle of elevation of trajectory has been dominant. Namely, experiments have revealed that if the diameter of the liquid center of the golf ball is increased, the golf ball becomes softer than the conventional golf ball, thus resulting in increase of amount of deformation of the golf ball and decrease of spin thereof.

However, if the diameter of the liquid center of the golf ball is increased with the conventional surface area occupying rate of the dimples as disclosed in the above references (1) and (2), the surface area occupying rate of dimples becomes too small. As a result, amount of back spin of the golf ball defined by aerodynamic characteristics of the dimples is reduced, so that the lift of the golf ball reduces, and the angle of elevation of trajectory is small, thereby resulting in reduction of carry. Therefore, the golf ball does not have a flight distance longer than the conventional golf ball.

The thread wound golf ball having the liquid center is characterized by its higher controllability by increase of backspin in comparison with a two piece solid golf ball.

However, if the surface area occupying rate of the dimples in the thread wound golf ball having the liquid center is small, thereby the amount of back spin reduces and the lift of the golf ball decreases, the thread wound golf ball having the liquid center does not have the advantage of the higher controllability.

SUMMARY OF THE INVENTION

The present invention has been developed with a view to substantially solving the above described disadvantages and has for its essential object to provide an improved thread wound golf ball having the liquid center, in which the liquid center diameter is larger than 28.3 mm, i.e., a liquid center diameter of the conventional golf ball and the surface area occupying rate of the dimples thereof are so combined as not only to increase the flight distance but also to optimize the trajectory.

In order to accomplish this object of the present invention, a golf ball according to the present invention comprises: a liquid center, a rubber thread layer formed around the liquid center and a cover covering the rubber thread layer, wherein said liquid center has a diameter of 29.5 to 32.0 mm and the ratio, Y, of the sum total of the flat surface area surrounded by an outer edge of each dimple to the surface area of an imaginary spherical surface of golf ball, namely, the surface area of the same sphere having no dimples formed thereon, is within the range of 0.80 to 0.84.

The total volumes of dimples of the golf ball are preferably in the range of 290 to 340 $mm^3$. Number of the dimples, a configuration of each dimple and a diameter of each dimple is not limited within said range at the total volume of dimples.

However, the total number of dimples ranges from 300 to 500 preferably, from 350 to 450 much preferably and a golf ball having 400 dimples is the best. Although the diameter of each dimple may be identical with each other, it is preferable that a plurality kinds of dimples having different diameters are disposed since a gap between dimples is reduced so that the dimples are densely disposed. Therefore, it is preferable that the diameter of each dimple ranges from 2.8 to 4.2 mm.

For example, it is preferable that the golf ball has 400 dimples in total number including 216 dimples with diameter of 4.15 mm, 120 dimples with diameter of 3.75 mm, 32 dimples with diameter of 3.25 mm and 32 dimples with diameter of 2.85 mm.

In the present invention, since the diameter of the liquid center ranges from 29.5 to 32.0 mm so that the diameter of the golf ball is larger than that of the conventional golf ball having a liquid center of 28.3 mm diameter, the golf ball is softer and amount of deformation is increased. Therefore, in the present invention, amount of spin is reduced at an initial stage of flying and an angle of elevation of trajectory becomes large so that the golf ball has a long flight distance.

Meanwhile, if the liquid center is increased in diameter keeping the conventional surface area occupying rate of the dimples, the trajectory tends to be lower excessively. However, in the present invention, since the surface area occupying rate of the dimples is set to 0.80 to 0.84, i.e. larger than that of the conventional golf ball, aerodynamic characteristics by the dimples are improved. Therefore, since lift of the golf ball is increased, the trajectory thereof becomes high. In other words, the golf ball does not become a so-called "rod ball" at a low trajectory. Therefore, a value of the carry becomes great, in result, a long flight distance in total are obtained.

Furthermore, since an upper limit of surface area occupying rate of the dimples is set to 0.84, the golf ball is prevented from becoming a so-called "hop ball" with a too high trajectory, thereby resulting in obtaining a long run and a long flight distance in total.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
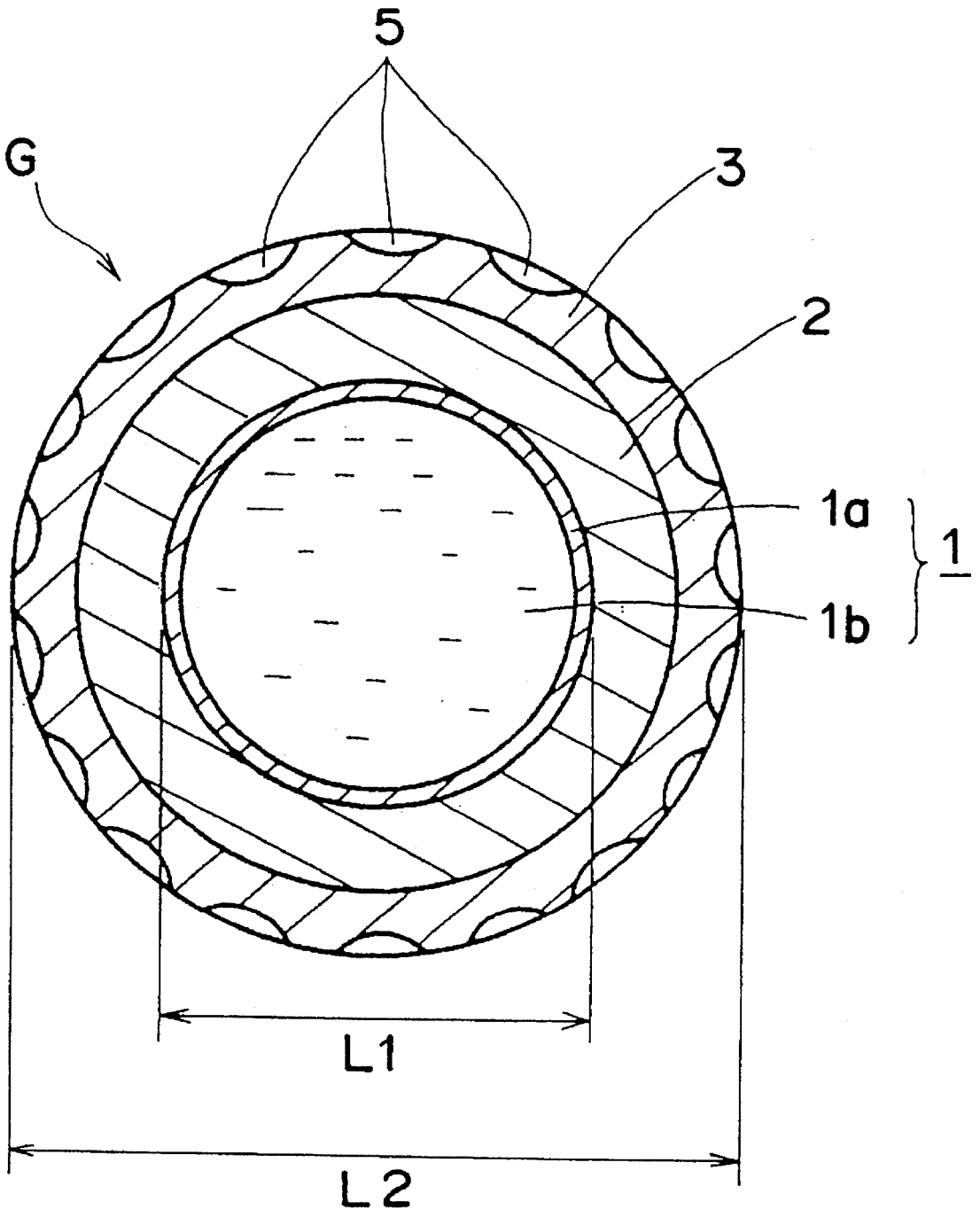
FIG. 1 is a sectional view schematically showing a conventional construction of a thread wound golf ball having a liquid center.

Before the description of the present invention proceeds, it is to be noted that like parts are designated by like reference numerals throughout several views of the accompanying drawings.

Hereinbelow, a golf ball according to the present invention will be described in detail with reference to the drawings.

A fundamental construction of the golf ball according to the present invention is the same as that shown in FIG. 1. The liquid center 1 has a diameter L1 of 29.5 to 32.0 mm, which is larger than the liquid center of 28.3 mm diameter in the conventional golf ball.

The rubber thread layer 2 of the golf ball G according to the present invention has a thickness smaller than that of the conventional golf ball, while the cover 3 has a thickness identical with that of the conventional golf ball. The golf ball G according to the present invention is identical with the conventional golf ball in its outer diameter and weight, i.e. 42.75 mm and 45.4 g, respectively.

The liquid center 1 includes a liquid center bag 1*a* into which pasty specific gravity adjusting agent 1*b* is injected. The specific gravity adjusting agent 1*b* contains water, glycerin, clay or barium sulfate, etc. Specific gravity of this liquid paste is, in general, 1.1 or more, or particularly preferably 1.3 or more.

The liquid center bag 1*a* is made of natural rubber, filler containing calcium carbonate, barium sulfate, zinc oxide and sulfur+curing accelerator. The liquid center bag 1*a* has a thickness of 1.5 to 2.0 mm.

The rubber thread layer 2 is constituted by elastic rubber thread of 0.4–0.6 mm thick made of natural rubber and/or isoprene rubber.

In the present invention, since the diameter of the liquid center is increased, the consumption of rubber thread to be wound is decreased as much in order to obtain the same outer diameter of the golf ball as that of the conventional golf ball.

However, since the required hardness is not obtained by decrease of the consumption of rubber thread, rubber thread with a high stretching rate is used to achieve the required hardness. For example, rubber thread comprising natural rubber and isoprene rubber, with a greater ratio of isoprene rubber, is preferable. The core diameter after winding rubber thread is the same as that of the conventional golf ball, i.e. 39.8 mm. The thickness of the cover 3 is also the same as that of the conventional golf ball.

The cover 3 is made of resin, such as synthetic trans-polyisoprene, gutta-percha, balata, high styrene resin, 1, 2-polybutadiene, or trans-polybutadiene, etc.

Figure 2:
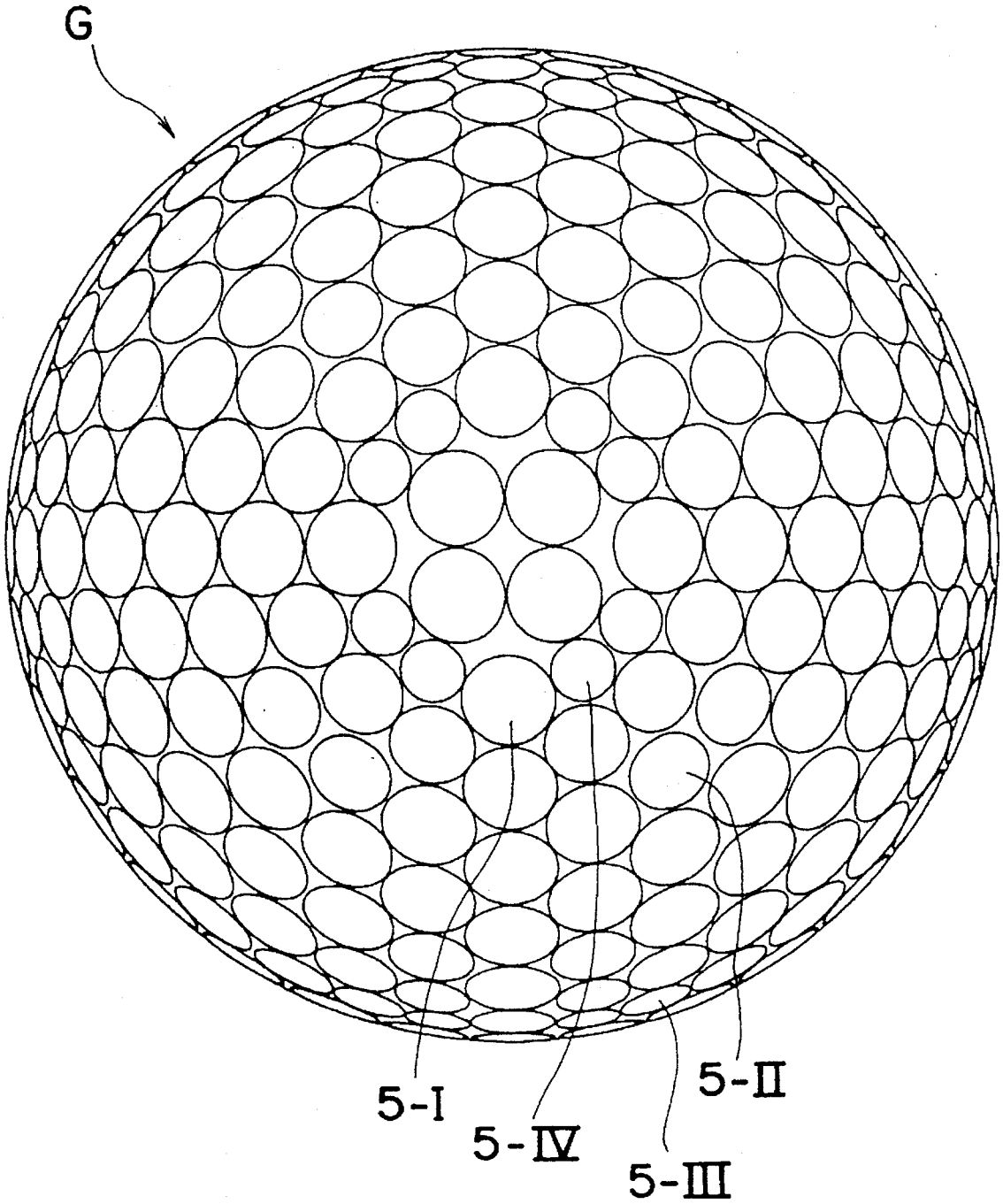
FIG. 2 is a front elevational view of a golf ball according to the present invention.
Figure 3:
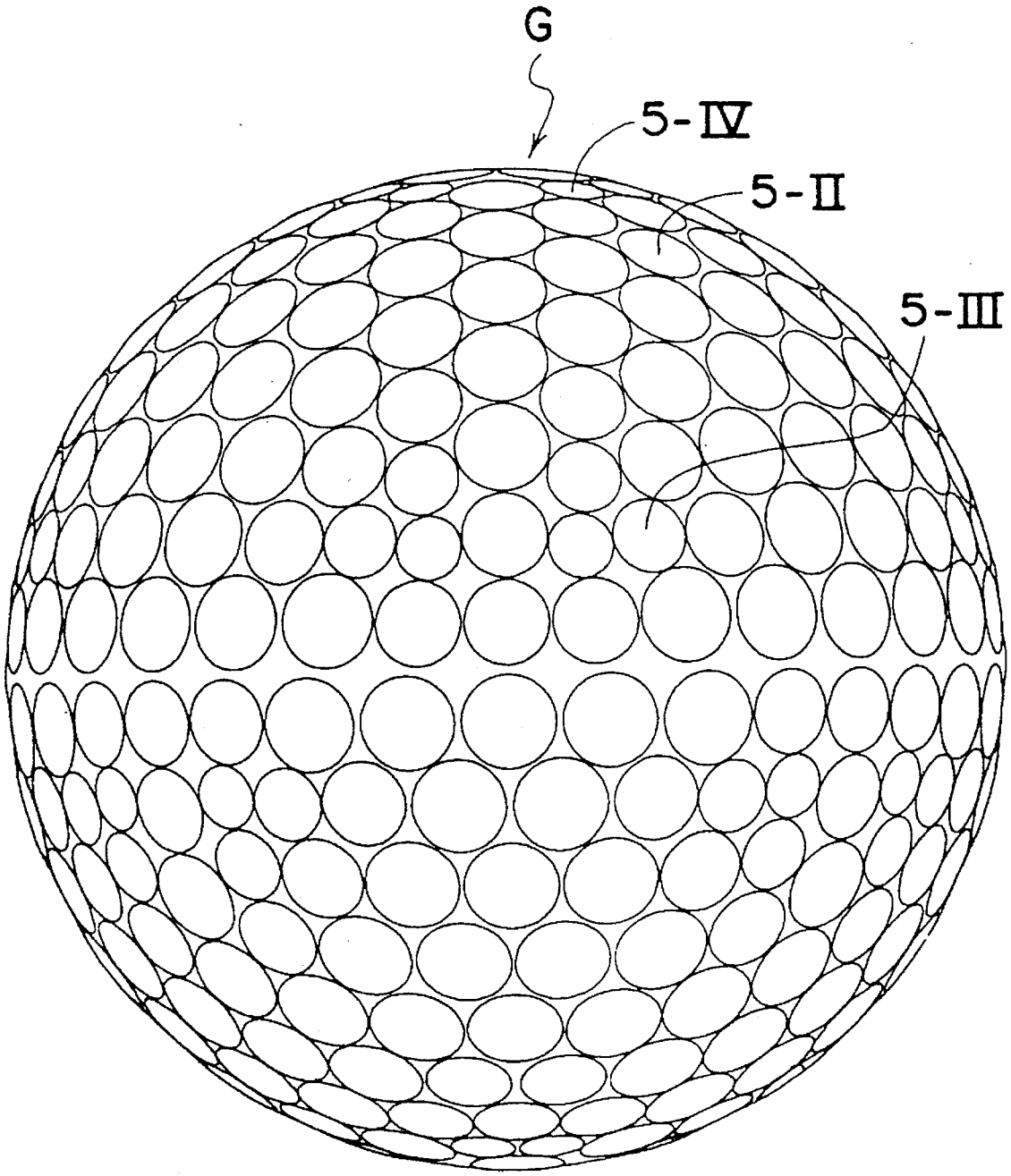
FIG. 3 is a bottom view of the golf ball of FIG. 2.

FIG. 2 is a front elevational view of the golf ball G, while FIG. 3 is a bottom view of the golf ball G. As shown in FIGS. 2 and 3, the golf ball G is formed, on its surface, with a large number of dimples 5 having different diameters.

Figure 4:
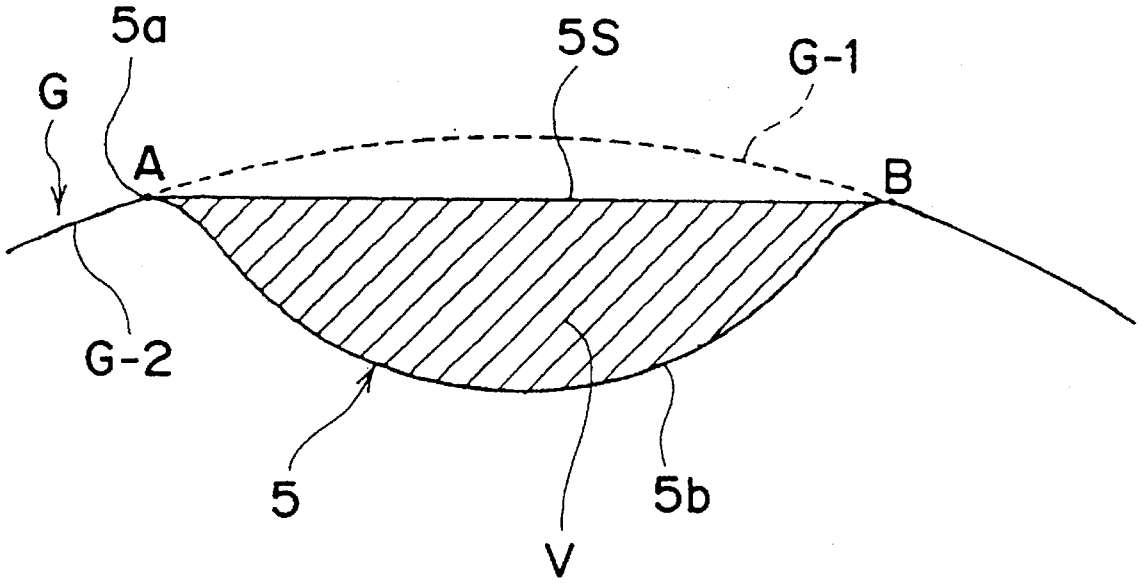
FIG. 4 is an enlarged view of a dimple of the golf ball of FIG. 2.

As shown in FIG. 4, when the area of the dimple 5 is represented by an area of a flat surface 5S surrounded by an outer edge 5*a* of each dimple 5, a ratio Y of the sum total of the areas of all dimples 5 provided on the golf ball G, to the surface area of the imaginary spherical surface of the golf ball G, is set to 0.80 to 0.84.

More specifically, in the case of a spherical dimple, the area of the dimple 5 means the area of a circle defined by intersection of part of a sphere forming the dimple, with the spherical surface of the golf ball G, i.e. the area of a circle having a diameter connecting points A and B in FIG. 4.

On the other hand, the surface area of an imaginary spherical surface of the golf ball G means the surface area of a sphere on the assumption that the golf ball is of a sphere having no dimples formed thereon, and includes the imaginary spherical portion G-1 shown by a dotted line and a land portion G-2 represented by a solid line in FIG. 4.

The above value Y (Y=0.80–0.84) may be regarded as an index showing the extent of the spherical surface of the golf ball covered by the dimples 5, and 100 times the value Y represents the surface area occupying rate of the dimples.

Namely, in the liquid type golf ball G according to the present invention, the diameter of the liquid center is larger than that of the conventional golf ball, and the surface area occupying rate of dimples is set to 80% and more, higher than that of the conventional golf ball, and 84% and less.

The above range of 0.80 to 0.84 for the value Y is determined by various experimental data to be described later, and "carry" and "run" of the golf ball having Y value of the above range are well balanced because the angle of elevation of trajectory is not small and large but optimum, thereby total flight distance is great.

As described later, according to the experimental data, when the value Y exceeds 0.84, the golf ball becomes a so-called "hop ball" with too high trajectory, with a small "run" and a short flight distance in total. Meanwhile, when the value Y falls below 0.80, the golf ball becomes a so-called "rod ball" at a low trajectory, with a small "carry" and a short flight distance in total.

A configuration, dimension and arrangement of each dimples 5 and total number and total volume of the dimples 5 are not limited as far as the ratio of the total area of the dimples 5 to the imaginary spherical surface area of the golf ball G is set within the range of the value Y.

However, it is preferable to set the total volume of the dimples in the range of 290 to 340 $mm^3$. The total volume of the dimples is a sum of volume of a hatched portion V in FIG. 4 surrounded by the surface 5S of the dimple 5 and a wall surface 5*b* of each of the dimple 5 on the golf ball G.

The above range of the total volume of the dimples 5 is obtained by experiments. In the case where the total volume is less than 290 $mm^3$, the golf ball is undesirably "blown up" so as to become the "hop ball", while when the total volume exceeds 340 $mm^3$, the trajectory is low, and in both cases, long flight distance can not be achieved.

As described above, the shape of the dimple 5 is not limited to a circle. However, as shown in FIGS. 2 and 3, it is preferable that the dimples 5 are circles having different diameters in order to optimize the value Y. If it is intended to increase the value Y, the gaps, i.e. the land portions G-2 among the dimples become large when only one kind of dimples are employed, and thus, the extent for increasing the value Y is undesirably limited. On the contrary, by combining the dimples with different diameters, it is possible to fill the gaps among the large dimples with small dimples, and thus, the value Y can be increased as required.

Therefore, the golf ball G according to first to sixth embodiments of the present invention shown in FIGS. 2 and 3 is provided with 400 dimples in total number having four different diameters.

In FIGS. 2 and 3, the dimples 5 includes first dimples 5-I, second dimples 5-II, third dimples 5-III and fourth dimples 5-IV. The diameter of the first dimple is 4.10–4.18 mm, that of the second dimples is 3.70–3.75 mm, that of the third dimple is 3.20–3.28 mm and that of the fourth dimple is 2.80–2.88 mm. The dimple diameter means a distance between points A and B in FIG. 4, respectively. The golf ball has 216 first dimples 5-I, 120 second dimples 5-II, 32 third dimples 5-III and 32 fourth dimples 5-IV.

EXPERIMENTS

Comparative tests were carried out through employment of golf balls according to the first to sixth embodiments and golf balls for first to fourth comparative examples as shown in Table 1 below.

The golf ball for the first to sixth embodiments has a liquid center of 29.5–32.0 mm diameter and the ratio Y of the total area of dimples to the total area of the imaginary spherical surface of the golf ball, namely, surface area occupying rate of the dimples, set to 0.80–0.84. A dimple pattern of the golf ball for each embodiments is identical with the dimple patterns shown in FIGS. 2 and 3.

The values Y or diameters of the liquid center of the golf balls for the first to fourth comparative examples are set to be out of range of those of the present invention.

The golf balls for the first to sixth embodiments and the first to fourth comparative examples have the liquid center, the rubber thread wound around the liquid center and the cover covering the rubber thread as shown in FIG. 1. The outer diameter of the golf ball is 42.75±0.05 mm and the compression is 86±3.

TABLE 1

| | Liquid Center Diameter (mm) | Number of Dimples | | | Dimple Diameter (mm) | Value Y | Total Volume of Dimples ($mm^3$) |
|---|---|---|---|---|---|---|---|
| 1st embod. | 30.0 | 400 | A | 216 | 4.100 | 0.801 | 320 |
| | | | B | 120 | 3.700 | | |
| | | | C | 32 | 3.200 | | |
| | | | D | 32 | 2.800 | | |
| 2nd embod. | 30.0 | 400 | A | 216 | 4.150 | 0.822 | 290 |
| | | | B | 120 | 3.750 | | |
| | | | C | 32 | 3.250 | | |
| | | | D | 32 | 2.850 | | |

TABLE 1-continued

| | Liquid Center Diameter (mm) | Number of Dimples | | | Dimple Diameter (mm) | Value Y | Total Volume of Dimples ($mm^3$) |
|---|---|---|---|---|---|---|---|
| 3rd embod. | 30.0 | 400 | A | 216 | 4.150 | 0.822 | 320 |
| | | | B | 120 | 3.750 | | |
| | | | C | 32 | 3.250 | | |
| | | | D | 32 | 2.850 | | |
| 4th embod. | 30.0 | 400 | A | 216 | 4.150 | 0.822 | 340 |
| | | | B | 120 | 3.750 | | |
| | | | C | 32 | 3.250 | | |
| | | | D | 32 | 2.850 | | |
| 5th embod. | 30.0 | 400 | A | 216 | 4.180 | 0.834 | 320 |
| | | | B | 120 | 3.780 | | |
| | | | C | 32 | 3.280 | | |
| | | | D | 32 | 2.880 | | |
| 6th embod. | 32.0 | 400 | A | 216 | 4.150 | 0.822 | 320 |
| | | | B | 120 | 3.750 | | |
| | | | C | 32 | 3.250 | | |
| | | | D | 32 | 2.850 | | |
| 1st compar. | 30.0 | 400 | A | 216 | 4.050 | 0.780 | 320 |
| | | | B | 120 | 3.650 | | |
| | | | C | 32 | 3.150 | | |
| | | | D | 32 | 2.750 | | |
| 2nd compar. | 30.0 | 400 | A | 216 | 4.230 | 0.856 | 320 |
| | | | B | 120 | 3.830 | | |
| | | | C | 32 | 3.330 | | |
| | | | D | 32 | 2.930 | | |
| 3rd compar. | 28.5 | 400 | A | 216 | 4.150 | 0.822 | 320 |
| | | | B | 120 | 3.750 | | |
| | | | C | 32 | 3.250 | | |
| | | | D | 32 | 2.850 | | |
| 4th compar. | 33.0 | 400 | A | 216 | 4.150 | 0.822 | 320 |
| | | | B | 120 | 3.750 | | |
| | | | C | 32 | 3.250 | | |
| | | | D | 32 | 2.850 | | |

In the first and second comparative examples in Table 1, although the diameter of the liquid center is set in the range of the present invention, the value Y is set to out of the range of the present invention. Namely, in the first comparative example, diameters of respective kinds of dimples are smaller than those of the golf ball according to the present invention, and consequently, the value Y is also small at 0.780. In the second comparative example, diameters of respective kinds of dimples are larger than those of the golf ball according to the present invention, with consequently large value Y at 0.856.

On the other hand, in the third and fourth comparative examples, although the value Y is set in the range of the present invention, diameter of the liquid center is set to out of the range of the present invention. Namely, in the third comparative example, the liquid center has a 28.5 mm diameter, which is smaller than that of the present invention and the same as that of the conventional golf ball. In the fourth comparative example, the liquid center has a 33.0 mm diameter, which is larger than that of the present invention.

The golf balls of the first to sixth embodiments and the first to fourth comparative examples were subjected to flight distance tests through employment of a swing robot manufactured by True Temper Co. Ltd. and by using a driver (No. 1 wood) at a head speed of 45 m/s. The wind was face wind at speed of 0.9 to 2.3 m/s.

For the respective 20 golf balls, measurements were taken on carry, run, total flight distance and trajectory height.

The "carry" represents a distance from a launching point of the golf ball to a point where the golf ball was first dropped, while the "run" denotes a distance from the above dropping point to a stopping point of the golf ball, and the "total" indicates the sum of carry and run, which represents an ultimate flight distance. The trajectory height represents an angle of elevation at the highest point of the trajectory as viewed from the launching point, and the larger the value thereof, the golf ball may be regarded to have a higher trajectory.

The results of the above measurements are shown in Table 2 below.

TABLE 2

| | Liquid Center Diameter (mm) | Value Y | Total Dimple Volume ($mm^3$) | Carry (yard) | Run (yard) | Total (yard) | Trajectory Height (DEG) |
|---|---|---|---|---|---|---|---|
| 1st embod. | 30.0 | 0.801 | 320 | 235.3 | 8.8 | 244.1 | 14.78 |
| 2nd embod. | ↑ | 0.822 | 290 | 234.1 | 5.8 | 239.9 | 15.23 |
| 3rd embod. | ↑ | ↑ | 320 | 236.7 | 8.5 | 245.2 | 14.90 |
| 4th embod. | ↑ | ↑ | 340 | 234.5 | 10.2 | 244.7 | 14.79 |
| 5th embod. | ↑ | 0.834 | 320 | 235.6 | 7.9 | 243.5 | 14.95 |
| 6th embod. | 32.0 | 0.822 | 320 | 233.7 | 9.6 | 243.3 | 14.74 |
| 1st compar. | 30.0 | 0.780 | 320 | 227.8 | 9.3 | 237.1 | 14.65 |
| 2nd compar. | ↑ | 0.856 | 320 | 231.5 | 6.4 | 237.9 | 15.30 |
| 3rd compar. | 28.5 | 0.822 | 320 | 231.8 | 5.2 | 237.0 | 15.21 |
| 4th compar. | 33.0 | ↑ | 320 | 225.7 | 10.4 | 236.1 | 14.72 |

From the test results of Table 2, the following points were noted.

(1) Comparing the first to fifth embodiments with the first comparative example, in which the diameter of the liquid center is identical with that of the first to fifth embodiments but the surface area occupying rate of the dimples is smaller than that of the first to the fifth embodiment, the trajectory height of the first to fifth embodiments is higher than that of the comparative example, i.e., the ball is not a "rod ball. Thus, carry is large and the total flight distance is prolonged. Namely, it has been found that, if the surface area occupying rate of the dimples is not lower than the predetermined value, i.e., the value Y is 0.80 or more, the ball is prevented from becoming the rod ball and thus, the total flight distance becomes large.

(2) Comparing the first to fifth embodiments with the second comparative example, in which the diameter of the liquid center is identical with that of the first to fifth embodiments but the surface area occupying rate of the dimples is set larger than the value of the present invention, the trajectory height in the first to fifth embodiments is lower than that of the second comparative example. In other words, the hit ball is not a "hop ball". Therefore, run and the total flight distance are large. Namely, it has been found that if the surface area occupying rate of the dimples is lower than the value of the present invention, i.e., the value Y is 0.84 or less, the hit ball does not become a "hop ball", resulting in a large flight distance.

(3) The second to fourth embodiments are compared with the third comparative example, in which the surface area occupying rate of the dimples is identical with those of the second to fourth embodiments but the diameter of the liquid center is smaller than the value of the present invention. The second to fourth embodiments are large in both carry and run, thereby resulting in large total flight distance. Namely, it has been found that the flight distance is prolonged when the liquid center has a larger diameter, even if the surface area occupying rate of the dimples is not changed.

(4) The second to fourth embodiments are compared with the fourth comparative example, in which the surface area occupying rate of the dimples is identical with that of the second to fourth embodiments but the diameter of the liquid center is larger than the value of the present invention. In the second to fourth embodiments, the trajectory height is higher and carry is larger than the fourth comparative example. Although run is smaller than the fourth comparative example, the total flight distance is larger than the fourth comparative example. From the above, it has been found that if the diameter of the liquid center is larger than the value of the present invention, the trajectory height becomes low and the hit ball becomes a "rod ball", and thus carry becomes small and the total flight distance becomes small.

(5) The golf ball of the third embodiment flew best with the total flight distance of 245.2 yards among the golf balls of the first to sixth embodiment. The golf ball of the third embodiment has a liquid center of 30 mm diameter, the value Y of 0.822 and the total dimple volume of 320 $mm^3$.

The golf ball of the first embodiment, which has a liquid center diameter and the total dimple volume identical with those of the first embodiment and the value Y at 0.801, smaller than that of the third embodiment, has a trajectory height of 14.78, slightly lower than that of the third embodiment. However, the golf ball of the first embodiment flies comparatively well with the total flight distance of 244.1 yards.

Carry of the golf ball of the first embodiment is much larger than that of the first comparative example. The first comparative example has the value Y of 0.780, smaller than that of the first embodiment and the total flight distance thereof is 237.1 yards. From the above, it has been found that the appropriate value Y is 0.80 or more ($Y \geqq 0.80$).

(6) The golf ball in the fifth embodiment, in which the diameter of the liquid center and the total dimple volume are identical with those of the third embodiment and the value Y is 0.834, larger than that of the third embodiment, has a trajectory slightly higher than that of the third embodiment. However, the golf ball in the fifth embodiment flies comparatively well with the total flight distance of 243.5 yards.

In the second comparative example, the value Y is 0.856, larger than the fifth embodiment and the total flight distance is 237.9 yards. The golf ball in the fifth embodiment has carry and run larger than that of the second comparative example and thus, the total flight distance is larger than that of the second comparative example. From above, it has been found that the appropriate value Y is 0.84 and less ($Y \leqq 0.84$).

(7) In the golf ball of the sixth embodiment, in which the value Y and the total dimple volume are identical with those of the third embodiment but the diameter of the liquid center is 32 mm, larger than that of the third embodiment, the trajectory height and carry is smaller than the remaining embodiments including the third embodiment. However, run is large and total flight distance is 243.3 yards.

The larger the diameter of the liquid center, the lower the trajectory in the case where other conditions are identical. At this time, carry becomes small. However, in the sixth embodiment, carry is much longer than that of the fourth comparative example, in which the diameter of the liquid center is 33.0 mm, larger than that of the sixth embodiment. From above, it has been found that the appropriate diameter of the liquid center is 32 mm and less.

(8) A golf ball of the second embodiment has a liquid center diameter and the value Y identical with those of the third embodiment but total volume of dimples is 290 $mm^3$ which is smaller than that of the third embodiment of 320 $mm^3$. In the second embodiment, although trajectory is high and run is short, carry is comparatively long. Accordingly, in the second embodiment, total flight distance becomes 239.9 yards and it may be said that the golf ball flies well.

From above, in the case where other conditions are identical, the smaller the total volume of dimples the higher the trajectory. At this time, the golf ball becomes a "hop ball" with a short run. However, since the total flight distance is longer than that of the third and fourth comparative examples, in which the value Y and the total volume of dimples are identical with those of the third embodiment but the liquid center diameter is different from that of the third embodiment, it can be said that influence of the total volume of dimples upon the flight distance is small. Thus, it has been found that the total dimple volume is preferably not less than 290 $mm^3$ in the case where other conditions are within the range of the present invention.

(9) A golf ball of the fourth embodiment has a liquid center diameter and the value Y identical with those of the third embodiment but the total volume of dimples is 340 $mm^3$, which is larger than that of the third embodiment of 320 $mm^3$. In the fourth embodiment, the trajectory is slightly lower and carry is shorter than those of the third embodiment. However, in the fourth embodiment, run is larger than the third embodiment. Accordingly, the golf ball flew well with the total flight distance of 244.7 yards.

The larger the total volume of dimples, the lower the trajectory. At this time, the ball tends to becomes a "rod ball". However, from the above results, it has been found that the total dimple volume is preferably 340 $mm^3$ and less in the case where other conditions are within the range of the present invention.

As will be seen from the foregoing description of the golf ball according to the present invention, in the golf ball of the present invention comprising a liquid center, a thread rubber layer and a cover, in which the liquid center is designed to have a large diameter in order to decrease backspin so as to increase carry and flight distance, surface area occupying rate of dimples is set in a predetermined range, namely, 0.80–0.84 corresponding to the diameter of the liquid center, namely, diameter of 29.5–32 mm. Therefore, the trajectory height does not become excessively high nor low, the golf ball is prevented from becoming the so-called "hop ball" nor "rod ball". Thus, through the optimization of trajectory height, carry and run are well balanced so as to increase total of the flight distance of the golf ball.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A golf ball comprising a liquid center, a rubber thread layer formed around said liquid center, and a cover covering said rubber thread layer;

wherein said liquid center has a diameter of 29.5 to 32.0 mm and the ratio, Y, of the sum total of the flat surface area surrounded by an outer edge of each dimple to the surface area of the same sphere having no dimples formed thereon is within the range of 0.80 to 0.84.

2. A golf ball as claimed in claim 1, wherein the total volumes of the dimples are in the range of 290 to 340 $mm^3$.

3. A golf ball as claimed in claim 1, wherein said dimples include a plurality of kinds of dimples having different diameters.

4. A golf ball as claimed in claim 2, wherein said dimples include a plurality of kinds of dimples having different diameters.

* * * * *